US006485264B1

(12) United States Patent
Wu

(10) Patent No.: US 6,485,264 B1
(45) Date of Patent: Nov. 26, 2002

(54) ANTI-LEAKAGE DEVICE FOR A MANUAL AIR PUMP WITH A PRESSURE GAUGE

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/595,228

(22) Filed: Jun. 16, 2000

(51) Int. Cl.[7] ..... F04B 49/00
(52) U.S. Cl. ..... 417/63
(58) Field of Search ..... 417/63, 469; 280/201; 73/738

(56) References Cited

U.S. PATENT DOCUMENTS 5,947,706 A * 9/1999 Gapinski ..... 417/437
5,964,577 A * 10/1999 Chuang ..... 417/63
6,059,548 A * 5/2000 Campbell et al. ..... 417/555.1
6,079,954 A * 6/2000 Kownacki et al. ..... 417/63

FOREIGN PATENT DOCUMENTS

JP 04-203943 * 7/1992 ..... 73/738
JP 09-113389 * 5/1997

* cited by examiner

*Primary Examiner*—Charles G. Freay
(74) *Attorney, Agent, or Firm*—Alan D. Kamrath; Rider, Bennett, Egan & Arundel

(57) ABSTRACT

A manual air pump includes a cylinder defining a chamber therein. A piston rod includes a handle mounted to a first end thereof and a piston mounted to a second end thereof, the piston being slidably received in the chamber of the cylinder. An adaptor includes a first end and a second end that is communicated with the first end. The first end of the adaptor is communicated with the chamber of the cylinder. A pressure gauge includes a tubular plug formed thereon. The second end of the adaptor is mounted around the tubular plug such that air in the chamber of the cylinder is flowable to the pressure gauge via the second end of the adaptor. A hose includes a first end for inflation and a second end for sealingly receiving the tubular plug of the pressure gauge such that air in the chamber of the cylinder is flowable to the first end of the hose for inflation.

19 Claims, 5 Drawing Sheets

ANTI-LEAKAGE DEVICE FOR A MANUAL AIR PUMP WITH A PRESSURE GAUGE

BACKGROUND OF THE INVENTION

1. Field of the Invention

The present invention relates to an anti-leakage device for a manual air pump with a pressure gauge.

2. Description of the Related Art

FIG. 1 of the drawings illustrates a conventional manual air pump with a pressure gauge. The manual air pump includes a pressure gauge seat 95 with a passage 96 defined therein. Defined above the passage 96 is a receptacle 97 for securely engaging with an engaging tube 99 of a pressure gauge 98. Glue is applied to fill a clearance existing between the engaging tube 99 and the receptacle 97 to prevent leakage. A screw 100 with a hexagonal socket (not shown) is provided to enclose an open end (not labeled) of the passage 96, and glue is also applied to seal a clearance between the screw and the open end of the passage 96. Nevertheless, application of the glue is difficult to control and requires a skilled worker. Insufficient glue results in leakage, yet over-application of the glue results in a waste in material and causes an aesthetically unpleasing appearance.

SUMMARY OF THE INVENTION

It is an object of the present invention to provide an anti-leakage device for a manual air pump with a pressure gauge to allow easy, direct assembly and provide reliable leakage-proof effect.

In accordance with one aspect of the invention, a manual air pump comprises:

a cylinder defining a chamber therein;

a piston rod including a handle mounted to a first end thereof and a piston mounted to a second end thereof, the piston being slidably received in the chamber of the cylinder;

an adaptor including a first end and a second end that is communicated with the first end, the first end of the adaptor being communicated with the chamber of the cylinder;

a pressure gauge including a tubular plug formed thereon, the second end of the adaptor being mounted around the tubular plug such that air in the chamber of the cylinder is flowable to the pressure gauge via the second end of the adaptor; and a hose including a first end for inflation and a second end for sealingly receiving the tubular plug of the pressure gauge such that air in the chamber of the cylinder is flowable to the first end of the hose for inflation.

The cylinder includes a lower end to which a base is securely mounted. The cylinder further includes an upper end with an outer threading. An end cap is mounted to the upper end of the cylinder for preventing disengagement of the piston. The end cap has an inner threading for engaging with the outer threading of the cylinder, the end cap including a longitudinal hole through which the piston rod extends.

The cylinder includes a transverse slot defined in a lower end thereof. A connector includes a first end mounted in the transverse slot and communicated with the chamber of the cylinder. The connector further includes a second end that communicates the first end of the connector with the first end of the adaptor. In an embodiment of the invention, the second end of the connector and the first end of the adaptor are communicated with each other by a conduit and an elbow.

In a preferred embodiment of the invention, the cylinder includes a transverse slot defined in a lower end thereof. An L-shape connector includes a horizontal section mounted in the transverse slot and communicated with the chamber of the cylinder. The connector further includes a vertical section that is located outside the cylinder and communicates with the horizontal section. The vertical section provides intercommunication between the first end of the connector and the first end of the adaptor. The horizontal section of the connector includes at least one O-ring mounted therearound to provide a sealing effect between the horizontal section of the connector and the cylinder.

The tubular plug includes a first end that is adjacent to the pressure gauge and a second end that is distal to the pressure guage. The first end of the tubular plug includes at least one O-ring mounted therearound to provide a sealing effect between the tubular plug and the second end of the adaptor. The second end of the tubular plug is preferably conic.

A pressure gauge seat is securely attached to the cylinder for receiving the pressure gauge. The pressure gauge seat comprises a through-hole through which the tubular plug extends.

In accordance with a second aspect of the invention, a manual air pump comprises:

a cylinder defining a chamber therein;

a piston rod including a handle mounted to a first end thereof and a piston mounted to a second end thereof, the piston being slidably received in the chamber of the cylinder;

an adaptor including a horizontal section and a vertical section that is communicated with the horizontal section, the horizontal section of the adaptor being communicated with the chamber of the cylinder, the vertical section including a first end and a second end;

a pressure gauge including a tubular plug on an end thereof, the vertical section of the adaptor being mounted around the tubular plug such that air in the chamber of the cylinder is flowable to the pressure gauge, the tubular plug including an outer threading and a conic end;

a hose including a first end for inflation and a second end mounted around the conic end of the tubular plug of the pressure gauge such that air in the chamber of the cylinder is flowable to the first end of the hose for inflation; and a hollow attaching member including an inner threading for engaging with the outer threading of the tubular plug, the hollow attaching member including a conic section for preventing leakage between the conic end of the tubular plug and the second end of the hose.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
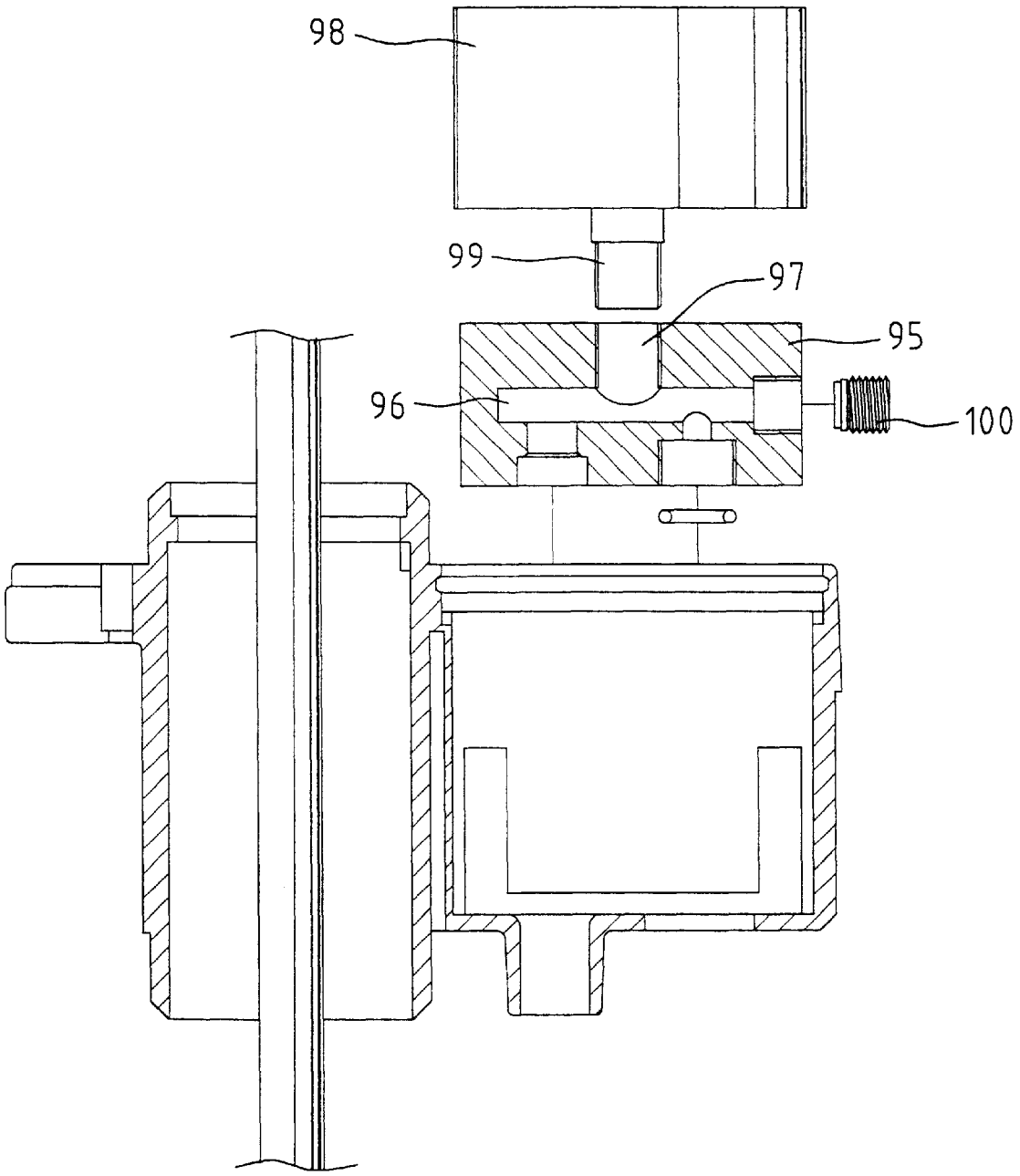
Fig. 1 PRIOR ART
FIG. 1 is a sectional view of a portion of a conventional manual air pump with a pressure gauge.
Figure 2:
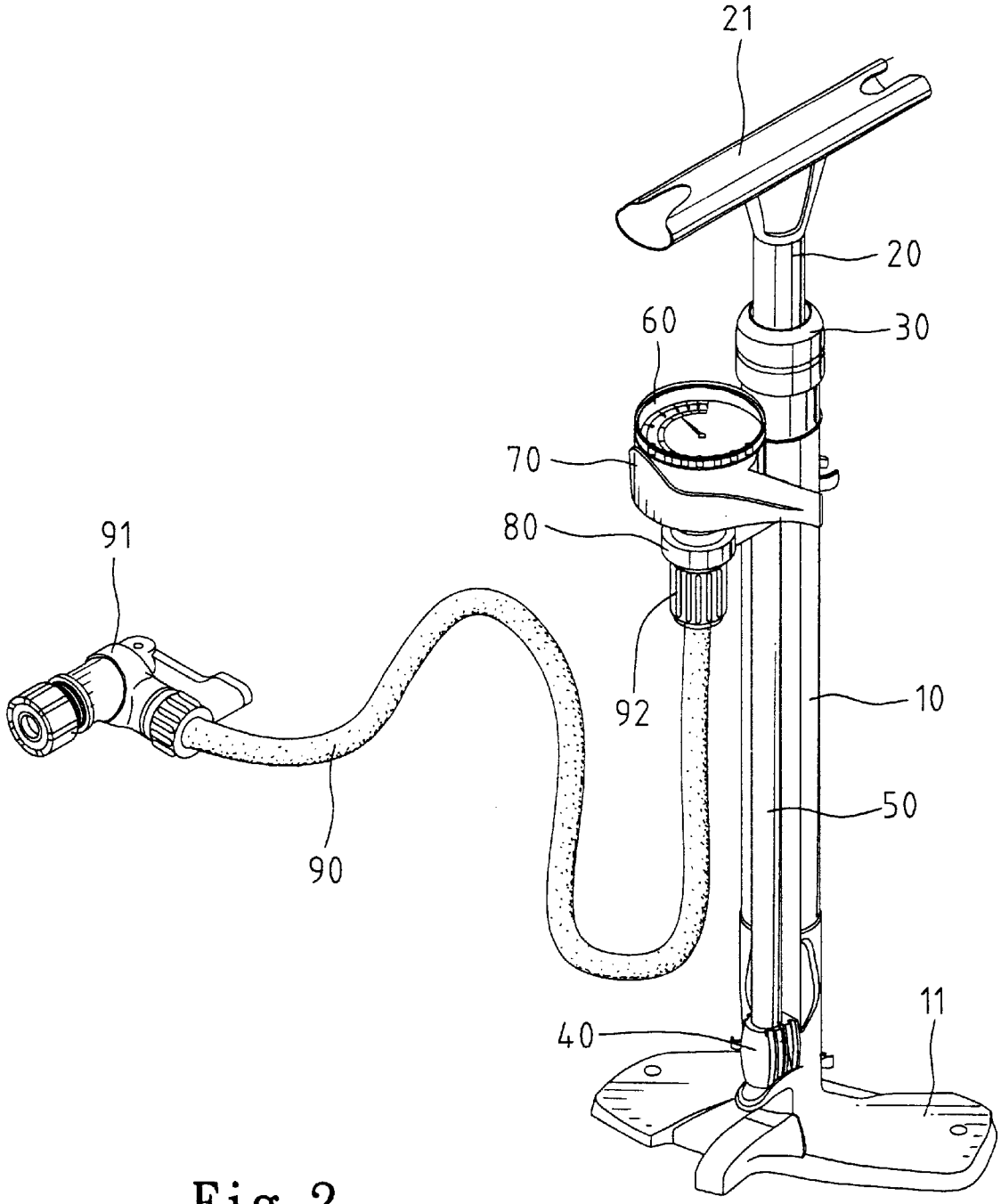
FIG. 2 is a perspective view of a manual air pump with an anti-leakage device in accordance with the present invention.
Figure 3:
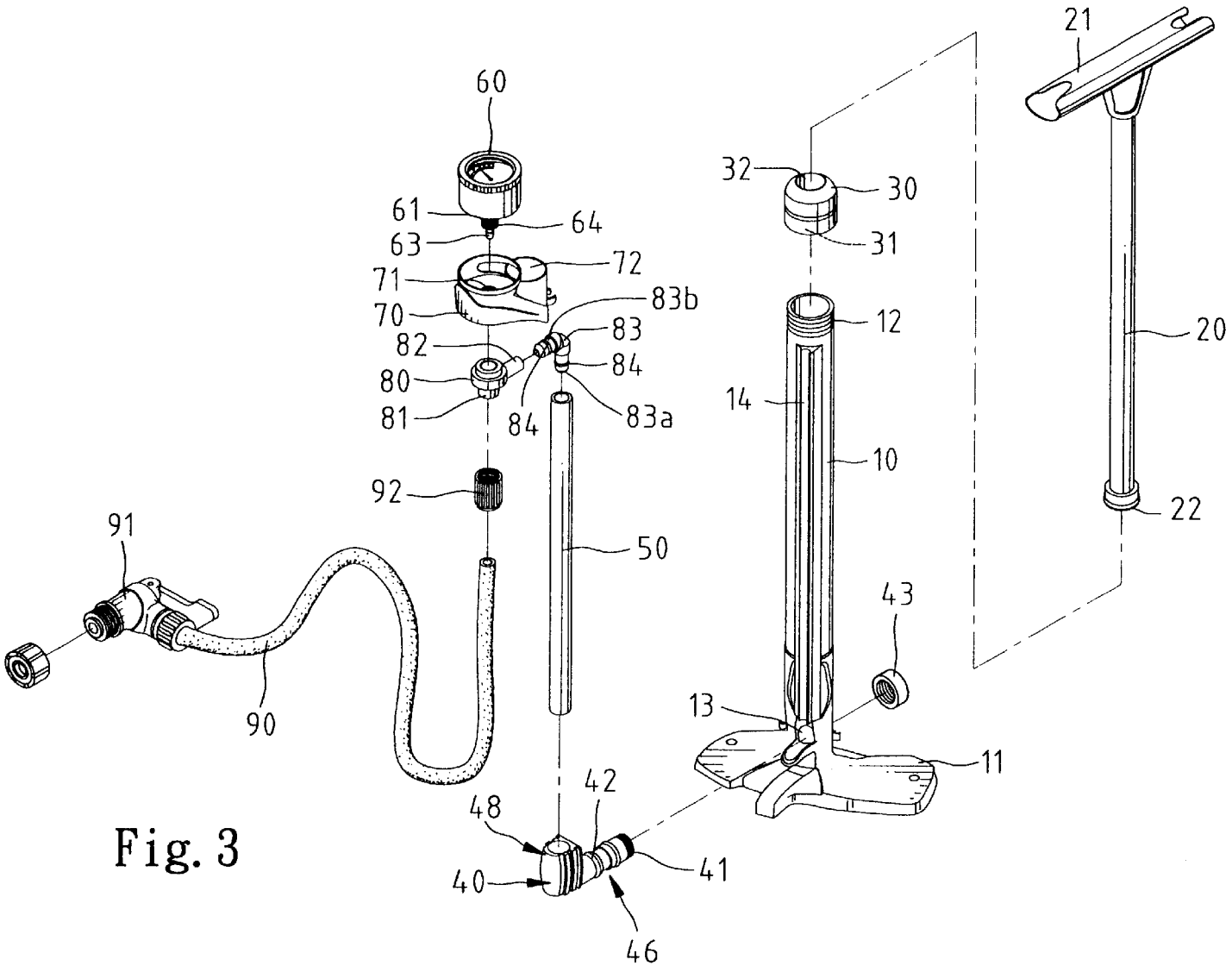
FIG. 3 is an exploded perspective view of the manual air pump in FIG. 2.

Referring to FIGS. 2 through 5 and initially to FIGS. 2 and 3, a manual air pump in accordance with the present invention generally includes a cylinder 10 and a base 11 attached to a lower end of the cylinder 10. An outer threading 12 is formed on an upper end of the cylinder 10. A transverse slot 13 (FIG. 4) is defined in the lower end of the cylinder 10. A vertical connecting seat 14 is formed on an outer periphery of the cylinder 10. A piston rod 20 includes a handle 21 securely attached to an end thereof for user's grasp and a piston 22 securely attached to the other end thereof. The piston 22 is slidably received in a chamber 10*a* defined in the cylinder 10 and communicated with the transverse slot 13, best shown in FIG. 4.

Figure 4:
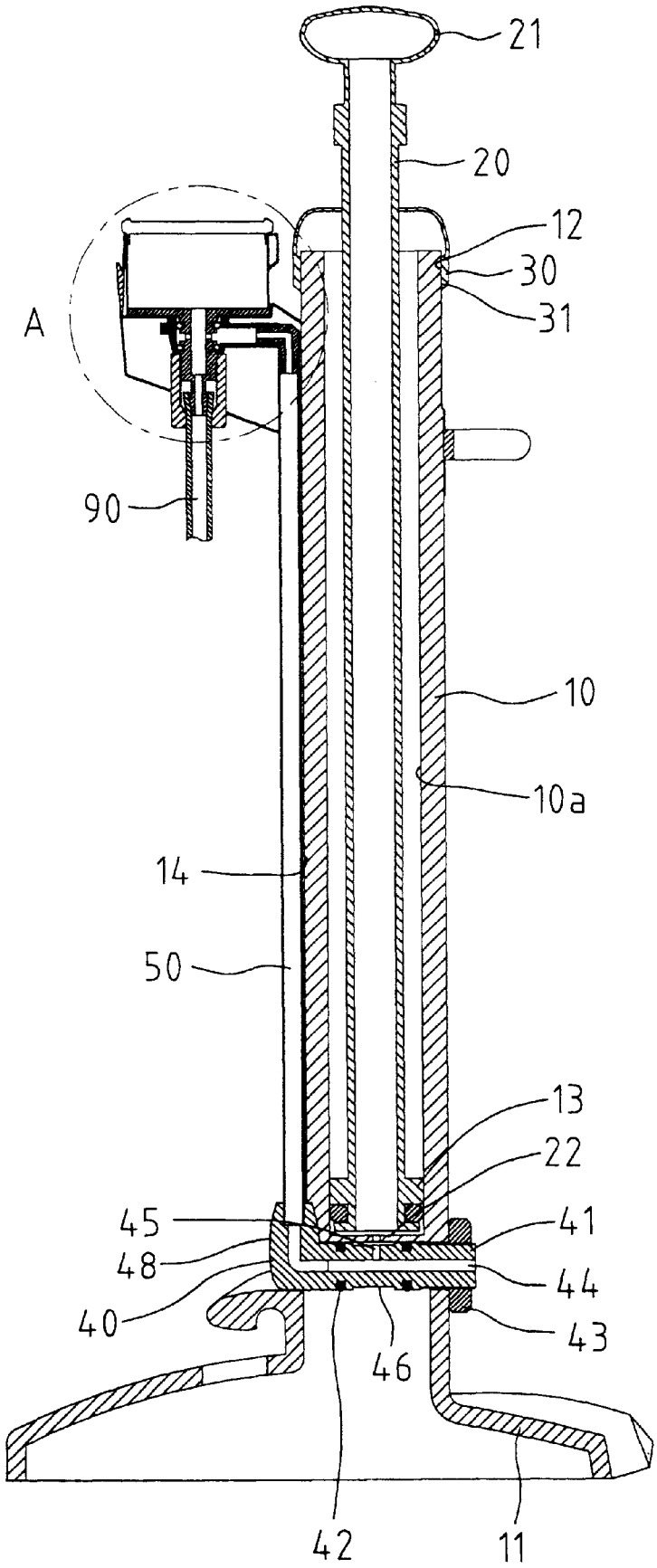
FIG. 4 is a sectional view of the manual air pump in FIG. 2.

An end cap 30 includes an inner threading 31 for engaging with the outer threading 12 of the upper end of the cylinder 10. The end cap 30 includes a longitudinal hole 32 (FIG. 3) through which the piston rod 20 extends, as shown in FIG. 4. The end cap 30 prevents disengagement of the piston 22.

A substantially L-shape connector 40 includes an outer threading 41 on a distal end of a horizontal section 46 thereof. Also formed on the horizontal section 46 is at least one O-ring 42 to provide required sealing effect when the horizontal section 46 of the connector 40 is mounted in the transverse slot 13 of the cylinder 10. A nut or screw cap 43 is provided to secure the distal end of the horizontal section 46, best shown in FIG. 4. The L-shape connector 40 further includes a vertical section 48 that is located outside the cylinder 10. The vertical section 48 and the horizontal section 46 together define an L-shape passage 44 that communicates with the chamber 10*a* of the cylinder 10 via a connecting passage 45 defined in the horizontal section 46 (FIG. 4).

Figure 5:
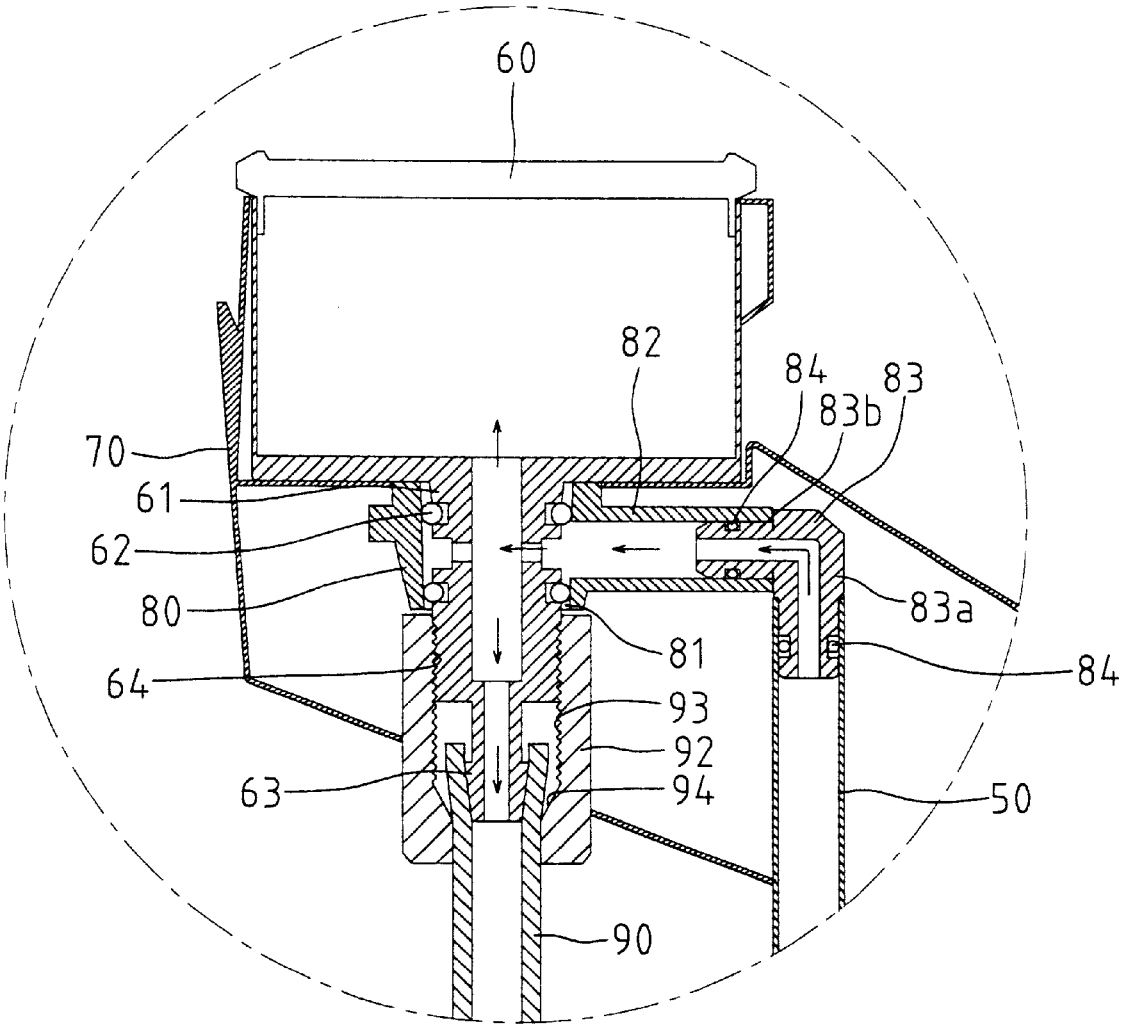
FIG. 5 is an enlarged view of a circle in FIG. 4.

A conduit 50 is mounted to the connecting seat 14 on the outer periphery of the cylinder 10. The conduit 50 includes a lower end communicated with an end of the L-shape passage 44. An elbow 83 includes a vertical limb 83*a* connected to an upper end of the conduit 50 and a horizontal limb 83*b*, each limb 83*a*, 83*b* having an O-ring 84 mounted thereon. An adaptor 80 is connected to the horizontal limb 83*b*. The adaptor 80 includes a horizontal section 82 that is communicated with the conduit 50 via the elbow 83 and a vertical section 81 that is communicated with the horizontal section 82 in an intermediate portion thereof. As illustrated in FIG. 5, the horizontal section 82 of the adaptor 80 is securely mounted around the horizontal limb 83*b* of the elbow 83.

Referring to FIGS. 2 and 3, a pressure gauge seat 70 is attached to the cylinder 10 by an attaching member 72. As illustrated in FIGS. 3 and 5, the pressure gauge seat 70 provides a seat for positioning a pressure gauge 60 and includes a through-hole 71. The pressure gauge 60 includes a tubular plug 61 mounted to an underside thereof and extended in the through-hole 71. The tubular plug 61 includes at least one O-ring 62 provided to an end thereof that is adjacent to the pressure gauge 60. The other end of the tubular plug 61 is a conic end 63. An outer threading 64 is defined between the conic end 63 and the lower O-ring 62. As illustrated in FIG. 5, the vertical section 81 of the adaptor 80 holds the tubular plug 61.

A hose 90 includes an attaching member 92 on an upper end thereof and an inflation head 91 on a lower end thereof for inflation. As illustrated in FIG. 5, the attaching member 92 is hollow and includes an inner threading 93 on an upper end thereof for engaging with outer threading 64 on the tubular plug 61. The lower inner end 94 of the attaching member 92 tapers to prevent disengagement of the upper end of the hose 90 that receives the conic end 63. Thus, the hose 90 is securely attached.

Referring to FIGS. 4 and 5, during inflation upon reciprocating operation on the handle 21, the piston 22 pumps air inside the chamber 10*a* of the cylinder 10 into the passage 44 via the connecting passage 45. Then, air enters the horizontal section 82 of the adaptor 80 via the conduit 50 and the elbow 83. Most of the air is outputted via the inflation head 91 on the hose 90 for inflation. A small amount of the air enters the pressure gauge 60 to show the pressure magnitude. It is noted that the conic end 63 of the tubular plug 61 of the pressure gauge 60 is in intimate contact with the outer periphery of the upper end of the hose 90 and retained inside the attaching member 92 by means of the tapered lower inner end 94 of the attaching member 92 and the conic end 63.

According to the above description, it is appreciated that reliable pressure detection is provided without causing troublesome assembly procedure (such as gluing) for the manual air pump. The structure is simple, the assembly procedure is easy, and the cost is low.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

a cylinder defining a chamber therein, with the cylinder including a transverse slot in a lower end thereof;

a piston rod including a handle mounted to a first end thereof and a piston mounted to a second end thereof, the piston being slidably received in the chamber of the cylinder;

a connector including a first end mounted in the transverse slot and communicated with the chamber of the cylinder, the connector further including a second end that is communicated with the first end of the connector; and a hose including a first end for inflation and a second end that is communicated with the second end of the connector such that air in the chamber of the cylinder is flowable to the first end of the hose for inflation.

2. The manual air pump as claimed in claim 1, wherein the cylinder includes a lower end to which a base is securely mounted, the cylinder further including an upper end with an outer threading, further comprising an end cap mounted to the upper end of the cylinder for preventing disengagement of the piston, the end cap having an inner threading for engaging with the outer threading of the cylinder, the end cap including a longitudinal hole through which the piston rod extends.

3. The manual air pump as claimed in claim 1, further comprising:

an adaptor including a first end and a second end that is communicated with the first end of the adapter, with the second end of the connector communicated with the first end of the adaptor; and a pressure gauge including a tubular plug formed thereon, with the second end of the adaptor being mounted around the tubular plug such that air in the chamber of the cylinder is flowable to the pressure guage via the second end of the adaptor.

4. The manual air pump as claimed in claim 3, wherein the second end of the connector and the first end of the adaptor are communicated with each other by a conduit and an elbow.

5. The manual air pump as claimed in claim 1, wherein the connector has an L-shape and includes a horizontal section mounted in the transverse slot and communicated with the chamber of the cylinder, the connector further including a vertical section that is located outside the cylinder and communicates with the horizontal section, the vertical section providing intercommunication between the first end of the connector and the second end of the hose.

6. The manual air pump as claimed in claim 5, with the horizontal section of the connector including at least one O-ring mounted therearound to provide a sealing effect between the horizontal section of the connector and the cylinder.

7. The manual air pump as claimed in claim 3, wherein the tubular plug includes a first end that is adjacent to the pressure gauge and a second end that is distal to the pressure gauge, the first end of the tubular plug including at least one O-ring mounted therearound to provide a sealing effect between the tubular plug and the second end of the adaptor.

8. The manual air pump as claimed in claim 7, wherein the second end of the tubular plug is conic upon which the second end of the hose is slideably received, with the tubular plug including an outer threading, with the manual air pump further comprising a hollow attaching member including an inner threading for engaging with the outer threading of the tubular plug, the hollow attaching member including an inner conic section, with the second end of the hose being sandwiched between the conic section of the hollow attaching member and the second, conic end of the tubular plug for preventing leakage between the conic end of the tubular plug and the second end of the hose.

9. The manual air pump as claimed in claim 3, further comprising a pressure gauge seat securely attached to the cylinder for receiving the pressure gauge.

10. The manual air pump as claimed in claim 9, wherein the pressure gauge seat comprises a through-hole through which the tubular plug extends.

11. A manual air pump comprising:

a cylinder defining a chamber therein;

a piston rod including a handle mounted to a first end thereof and a piston mounted to a second end thereof, the piston being slidably received in the chamber of the cylinder;

an adaptor including a horizontal section and a vertical section that is communicated with the horizontal section, the horizontal section of the adaptor being communicated with the chamber of the cylinder;

a pressure gauge including a tubular plug on an end thereof, the vertical section of the adaptor being mounted around the tubular plug such that air in the chamber of the cylinder is flowable to the pressure gauge, the tubular plug including an outer threading and a conic end;

a hose including a first end for inflation and a second end mounted around the conic end of the tubular plug of the pressure gauge such that air in the chamber of the cylinder is flowable to the first end of the hose for inflation;

a hollow attaching member including an inner threading for engaging with the outer threading of the tubular plug, the hollow attaching member including an inner conic section with the second end of the hose being sandwiched between the conic section of the hollow attaching member and the conic end of the tubular plug for preventing leakage between the conic end of the tubular plug and the second end of the hose, wherein the cylinder includes a transverse slot defined in a lower end thereof; and a connector including a first end mounted in the transverse slot and communicated with the chamber of the cylinder, the connector further including a second end that communicates the first end of the connector with the first end of the adaptor.

12. The manual air pump as claimed in claim 11, wherein the cylinder includes a lower end to which a base is securely mounted, the cylinder further including an upper end with an outer threading, further comprising an end cap mounted to the upper end of the cylinder for preventing disengagement of the piston, the end cap having an inner threading for engaging with the outer threading of the cylinder, the end cap including a longitudinal hole through which the piston rod extends.

13. The manual air pump as claimed in claim 11, wherein the second end of the connector and the first end of the adaptor are communicated with each other by a conduit and an elbow.

14. The manual air pump as claimed in claim 11, wherein the connector has an L-shape, with the connector including a horizontal section mounted in the transverse slot and communicated with the chamber of the cylinder, the connector further including a vertical section that is located outside the cylinder and communicates with the horizontal section, the vertical section providing intercommunication between the first end of the connector and the first end of the adaptor.

15. The manual air pump as claimed in claim 14, wherein the horizontal section of the connector including at least one O-ring mounted therearound to provide a sealing effect between the horizontal section of the connector and the cylinder.

16. The manual air pump as claimed in claim 11, wherein the tubular plug includes at least one O-ring mounted therearound to provide a sealing effect between the tubular plug and the vertical section of the adaptor.

17. The manual air pump as claimed in claim 16, further comprising a pressure gauge seat securely attached to the cylinder for receiving the pressure gauge.

18. The manual air pump as claimed in claim 18, wherein the pressure gauge seat comprises a through-hole through which the tubular plug extends.

19. A manual air pump comprising:

a cylinder defining a chamber therein;

a piston rod including a handle mounted to a first end thereof and a piston mounted to a second end thereof, the piston being slidably received in the chamber of the cylinder;

an adaptor including a first end and a second end that is communicated with the first end of the adaptor, the first end of the adaptor being communicated with the chamber of the cylinder;

a pressure gauge including a tubular plug formed thereon, the second end of the adaptor being mounted around the tubular plug such that air in the chamber of the cylinder is flowable to the pressure gauge via the second end of the adaptor; and a hose including a first end for inflation and a second end for sealingly receiving the tubular plug of the pressure gauge such that air in the chamber of the cylinder is flowable to the first end of the hose for inflation;

the tubular plug including a first end that is adjacent to the pressure gauge and a second end that is conic and that is distal to the pressure gauge, the first end of the tubular plug including at least one O-ring mounted therearound to provide a sealing effect between the tubular plug and the second end of the adaptor.

* * * * *